US005191160A

United States Patent [19]

Barnett

[11] Patent Number: 5,191,160

[45] Date of Patent: Mar. 2, 1993

[54] GUITAR POSITIONING DEVICE

[76] Inventor: Mark C. Barnett, 350 Anderson La., Hendersonville, Tenn. 37075

[21] Appl. No.: 791,775

[22] Filed: Jan. 9, 1992

[51] Int. Cl.[5] ..... G10D 3/00

[52] U.S. Cl. ..... 84/327; 248/316.4

[58] Field of Search ..... 84/327, 453; 248/316.4, 248/288.3, 181

[56] References Cited

U.S. PATENT DOCUMENTS

| | | | |
|---|---|---|---|
| 3,037,416 | 6/1962 | Cunningham | 84/327 |
| 3,102,446 | 9/1963 | Raleigh | 84/327 |
| 5,000,071 | 3/1991 | Thomas | 84/327 |
| 5,069,103 | 12/1991 | Henry | 84/327 |

*Primary Examiner*—Michael L. Gellner

*Assistant Examiner*—Cassandra C. Spyrou

[57] ABSTRACT

A metal waist band held firmly in place by an adjustable nylon strap supports a lockable ball joint to which an adjustable bracket rod is affixed clasping the instrument and holding it away from the deadening effects of one's body. This device provides the following new capabilities: improved instrument stability, improved instrument positionability, improved instrument volume, and improved instrument tone quality. The player benefits from the stand point of health by the fact that the device places the weight of the instrument at the waist, devoiding neuromuscular problems frequently resulting from the shoulder method. Furthermore, the stability and position of the instrument secured by this device affords the player a greater fluency of technique.

1 Claim, 1 Drawing Sheet

GUITAR POSITIONING DEVICE

SUMMARY OF THE INVENTION

The Mark Barnett Acoutic Instrument Maximizer is a stabilizing bracket (held in place by a belt about one's waist) for postioning a guitar, banjo mandolin etc. away from one's body affording greater vibration, thus marked improvement in volume and tone quality over the conventional around the neck strap device.

DETAILED DESCRIPTION OF THE INVENTION

Figure 1:
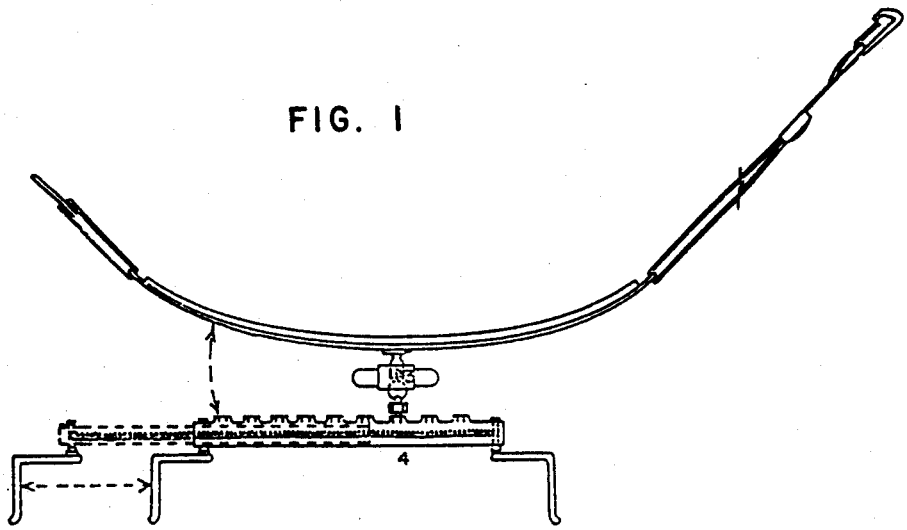
FIG. 1 shows a side view of the positioning apparatus.
Figure 2:
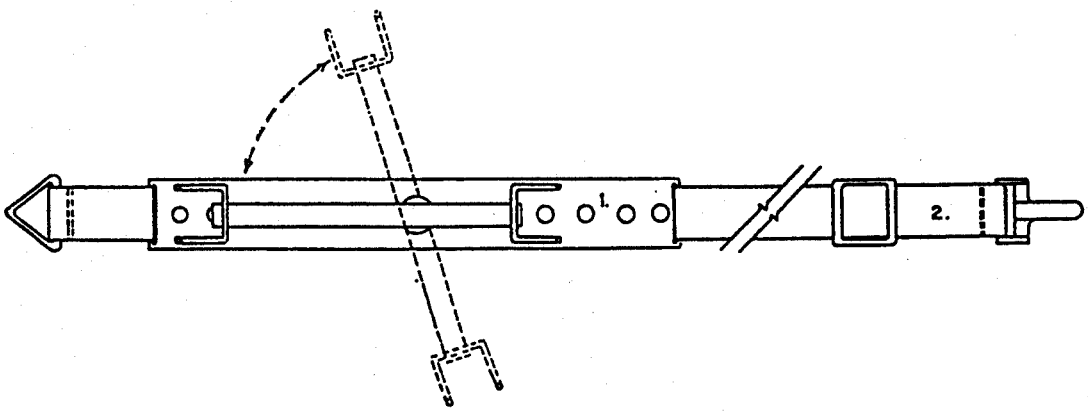
FIG. 2 shows a frontal view of the positioning apparatus.

1. Metal waist band:

Supports ball joint and attached bracket rod. It is perforated for weight reduction and is lined with rubber for comfort.

2. Adjustable nylon strap:

Snaps into ring securing device to body.

3. Ball joint:

It is a scored steel ball affixed atop a screw that attaches to bracket rod. A winged cap nut with hole in cap houses the ball and secures its convex surface to concave surface of bolt affixed to metal waist band. A plastic disc is placed between the two surfaces for stability. A lock nut assures tight fit of ball joint to tubular bracket rod 4. Bracket rod: Is telescopic and spring loaded for adjustment to different sized instruments. Secures instrument to device by tension of spring and friction of rubber coated "grippers" at either end of bracket rod. Location of rod to ball joint is adjustable by means of nine nuts affixed along the bracket rod. Grippers swival to accomodate differing shapes of instruments.

ADVANTAGES AND USES

1. Maximizes instrument stability.
2. Maximizes proper instrument position.
3. Maximizes instrument tone quality.
4. Maximizes instrument volume.
5. Maximizes health advantages: Since weight of instrument is toward center of body, numbness and pain from pressure on shoulders and back cannot develope.
6. Maximizes ease of use: Simply clips on and off instrument in one quick motion. Belt also snaps on or off easily with one quick move.
7. Maximizes technique: Because instrument is stabilized and positioned properly by this device rather than the musician's effort, relaxation and other aspects of technique are now maximal.

I claim:

1. A guitar positioning apparatus comprising:

an adjustable waist band;

a telescopic bracket rod having a screw;

a ball attached atop the screw;

a nut having a wing cap; the wind cap having a hole therein;

said nut being affixed to said waist band;

said ball being housed within the hole in said wing cap.

* * * * *